US006232267B1

(12) United States Patent
Oshima et al.

(10) Patent No.: US 6,232,267 B1
(45) Date of Patent: May 15, 2001

(54) THERMAL TRANSFER SHEET AND METHOD FOR MANUFACTURING SAME

(75) Inventors: Katsuyuki Oshima; Satoru Kawai; Hideki Usuki, all of Tokyo-to (JP)

(73) Assignee: DAI Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/109,441

(22) Filed: Jul. 2, 1998

(30) Foreign Application Priority Data

Jul. 3, 1997 (JP) ..... 9-178361

(51) Int. Cl.[7] ..... B41M 5/035; B41M 5/38

(52) U.S. Cl. ..... 503/201; 428/195; 428/913; 428/914; 503/204; 503/227

(58) Field of Search ..... 428/195, 913, 428/914; 8/471; 503/227

(56) References Cited

U.S. PATENT DOCUMENTS 5,006,502 * 4/1991 Fujimura et al. ..... 503/227

5,409,883 * 4/1995 Larshus et al. ..... 503/227

* cited by examiner

*Primary Examiner*—Bruce H. Hess
(74) *Attorney, Agent, or Firm*—Ladas & Parry

(57) ABSTRACT

A thermal transfer sheet is comprises a substrate sheet, a dye layer of at least one color, a white layer to cover an image-receiving portion of a receiving material after an image is formed therein, and if necessary, a transferable receptor layer to be transferred to the image-receiving portion of the receiving material before the formation of the image, those layers being alternately disposed side by side on a surface of the substrate sheet, wherein said white layer being capable of adhering to the image-receiving portion already provided with the image and being disposed on the substrate sheet via a peeling layer interposed therebetween. The white layer has a white screenability to provide excellent light diffusivity and light transmissivity for a background of the printed image. The white layer may be formed by applying a coating liquid containing an adhesive binder resin and a white pigment or a coating liquid containing a binder resin, an adhesive, and a white pigment on the peeling layer.

1 Claim, 1 Drawing Sheet

THERMAL TRANSFER SHEET AND METHOD FOR MANUFACTURING SAME

BACKGROUND OF THE INVENTION

1. Field of the Invention

The present invention relates to a thermal transfer sheet comprising a substrate sheet, a dye layer, a white layer(white color layer) and optionally a receptor layer, alternately disposed side by side on a surface of the substrate sheet. Further, the present invention relates to a method for manufacturing the thermal transfer sheet.

2. Description of the Related Art

A printed product, which comprises a transparent transfer receiving material and an image formed on one side thereof so as to allow the image to be identified or enjoyed from the other side of the transparent transfer receiving material, is conventionally used in, for example, an electric decorating display for advertisement or decoration purposes. Usually, this electric decorating display comprises a transparent transfer receiving material/image/white layer, stacked in this order, so that the display is enjoyed by irradiating it either from the front side (the side of transparent transfer receiving material) or the back side (the side of white layer). In addition, the image formed by transfer can be made more distinct by appropriately transmitting or diffusing the irradiating light. Usually, for the purpose of diffusing the light, an electric decorating device, or a light diffusing layer is attached to the electric decorating display.

Heretofore, the electric decorating display is manufactured by a process comprising the steps of forming an image or letter by means of, for example, offset printing or gravure printing on a transparent plastic sheet which constitutes a transfer receiving material and then forming a solid printed with a white ink on the image or letter. This process for manufacturing an electric decorating display is suitable for the mass production of one and the same printed product.

Recently, however, in order to meet demands for, for example, personal use and many kinds in small quantities, it has become necessary to change letter or image every each sheet or small number of sheets.

In order to meet these demands, a desired printed product is manufactured by a process comprising the steps of transferring a receptor layer, which facilitates the image formation, from a receptor layer-transferring sheet to a transparent transfer receiving material such as a transparent plastic sheet, forming an image by ink jet printing or sublimation thermal transfer printing on the receptor layer, and transferring a white layer from a white layer transfer sheet onto the image thus formed. The sublimation thermal transfer printing in particular is drawing attentions because this method is expected to provide excellent continuous gradation and a full-color image comparable to that of a color photograph.

A sublimation thermal transfer process for producing a printed product required at least the transfer of a dye layer and a white layer, and further required the transfer of a receptor layer prior to the transfer of the dye layer if a transfer receiving material had insufficient dyeability. Accordingly, the sublimation thermal transfer process required the use of a plurality of thermal transfer sheets. In order to simplify the process, Japanese Patent Application Publication (JP-B) No. 7-77832 discloses an integrated thermal transfer sheet comprising a substrate sheet, a receptor layer, a dye layer and a white layer, wherein these layers are alternately disposed side by side on a surface of the substrate sheet as well as a method which enables a printed product to be manufactured at a lower cost by successively transferring these layers from the sheet to a transfer receiving material. The integrated thermal transfer sheet disclosed comprises a substrate sheet, a receptor layer-transferring portion having a three-layered structure composed of a peeling layer/a receptor layer/an adhesive layer, a dye layer for colors, and a white screen(white background)-transferring portion having a three-layered structure composed of a peeling layer/a white ink layer/an adhesive layer, alternately formed and disposed side by side on the substrate.

The above-mentioned integrated thermal transfer sheet, however, is associated with a problem that, since the process for forming the layers requires a number of steps including coating and drying, the process is complicated if the number of the layers is large, and, as a result, the production cost of the thermal transfer sheet becomes higher.

Another problem is that the white screenability of the printed product obtained by the above-mentioned process is poor, and this problem of insufficient white screenability of the printed product is associated with conventional processes.

In addition, it has been demanded to improve the conventional level of releasability of a receptor layer from a thermal transfer sheet supporting the receptor layer when the receptor layer excellent in dyeability is transferred to a transfer receiving material which has poor dyeability.

SUMMARY OF THE INVENTION

In order to solve these problems, a first object of the present invention is to provide a thermal transfer sheet which comprises a reduced number of layers and which facilitates the manufacture thereof and can be manufactured at a reduced cost, and to provide a method for manufacturing the thermal transfer sheet.

A second object of the present invention is to provide an integrated thermal transfer sheet which is designed for the manufacture of a printed product having excellent white screenability and which preferably has an easily peelable receptor layer.

In order to achieve the foregoing objectives, the thermal transfer sheet according to the present invention comprises a substrate sheet, a dye layer of at least one color and a white layer to cover(to be laid over) an image-receiving portion of a transfer receiving material after an image is formed therein, the dye layer and the white layer being alternately disposed side by side on a surface of the substrate, wherein the white layer can adhere to the image-receiving portion provided with the image in the transfer receiving material and is disposed on the substrate sheet via a peeling layer interposed therebetween.

When an image is formed on a transfer receiving material (such as a transfer receiving sheet) by transferring a dye thereto from the thermal transfer sheet of the present invention and a white layer is then transferred, the white layer is transferred directly to the transfer receiving material having the image formed therein without recourse to an adhesive layer. Accordingly, it is not necessary to form the adhesive layer on the white layer, and, as a result, a thermal transfer sheet can be provided at a reduced cost.

In one embodiment of the present invention, the white layer contains at least an adhesive binder resin and a white pigment. A preferred example of the adhesive binder resin is an acrylic resin. Because the white layer contains a binder resin such as an acrylic resin having an excellent adhesive capacity, the white layer exhibits excellent adherence to the image-receiving portion provided with the image in the transfer receiving material.

In another embodiment of the present invention, the white layer contains at least a binder resin, an adhesive and a white pigment. Where the white layer contains the adhesive, the adhesion of the white layer can be improved even if the binder resin of the white layer is not adhesive.

From the standpoint of the balance between adhesion and white screenability, a weight ratio (A/B) of the amount of the adhesive binder resin (A) or the total amount (A) of the binder resin and the adhesive to the amount (B) of the white pigment is preferably within the range of 1/1 to 1/10.

Although the basic role of the peeling layer is to enhance the transferability of the white layer, the peeling layer may contain the white pigment so that the peeling layer also has a white screenability. In the case where part or whole of the peeling layer is transferred together with the white layer to a transfer receiving material, a better white screening effect is imparted to an image if white screenability is given not only to the white layer but also to the peeling layer.

In the thermal transfer sheet of the present invention, the substrate sheet may have a detection mark. In addition, the substrate sheet may be surface-treated to improve adhesion.

Layers other than the dye layer and the white layer may be disposed on the thermal transfer sheet of the present invention. For example, the dye layer, the white layer and a transferable receptor layer, which is designed to be transferred to a transfer receiving material prior to image formation, may be alternately disposed side by side on the substrate sheet. The use of a thermal transfer sheet comprising the transferable receptor layer makes it possible to effectively form an image on a transfer receiving material having poor dyeability. Preferably, the transferable receptor layer has a multilayered structure which comprises at least a release layer, a receptor layer and an adhesive layer disposed in this order from near to the substrate sheet. This multilayered structure can improve the transferability of the receptor layer.

In a preferred transferable receptor layer, the receptor layer comprises a resin selected from the group consisting of a polyvinyl chloride resin, an acrylic/styrene copolymer resin and a polyester resin, while the release layer comprises at least one resin selected from the group consisting of a butyral resin, a polyvinyl acetate resin and a urethane resin. Preferably, the receptor layer of the transferable receptor layer contains a release agent in an amount of 0.5 to 10% by weight calculated with respect to the amount of the binder resin constituting the receptor layer.

The white layer may be formed by, for example, a process comprising the steps of forming a peeling layer in a predetermined portion of a substrate sheet surface and thereafter coating the same portion either with a coating liquid containing at least an adhesive binder resin and a white pigment, or with a coating liquid containing at least a binder resin, an adhesive and a white pigment.

DESCRIPTION OF THE PREFERRED EMBODIMENTS

Figure 1:
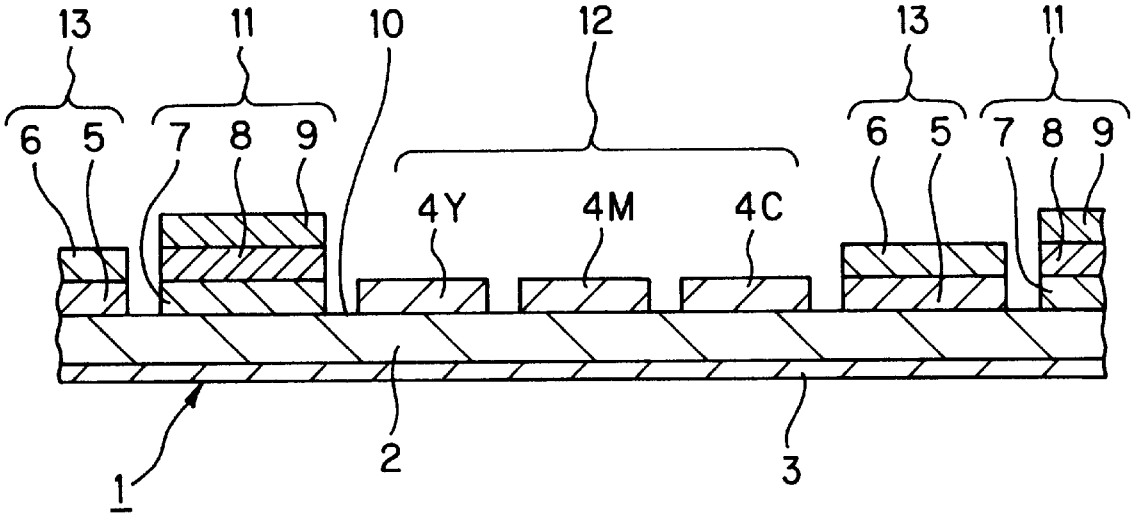
FIG. 1 is a sectional view illustrating an example of the integrated thermal transfer sheet of the present invention.

FIG. 1 is a sectional view illustrating an example of the integrated thermal transfer sheet (hereinafter referred to as thermal transfer sheet 1). In the thermal transfer sheet 1, a receptor layer-transferring portion 11, which has a multilayered structure comprising a release layer 7/a receptor layer 8/an adhesive layer 9 in this order, a dye layer-transferring portion 12, in which dye layers 4, i.e., a yellow layer 4Y, a magenta layer 4M and a cyan layer 4C, are disposed side by side, and a white layer-transferring portion 13, which has a multilayered structure comprising a peeling layer 5/a white layer 6 in this order, are alternately disposed side by side on one side of a substrate sheet 2. A heat resistant layer 3 may be disposed on the other side of the substrate sheet 2. Although the receptor layer-transferring portion 11 is preferably disposed together with the dye layer-transferring portion 12 and the white layer-transferring portion 13 on the substrate sheet 2 if the transfer receiving material has poor dyeability, the receptor layer-transferring portion 11 may be omitted if the transfer receiving material has good dyeability.

Figure 2:
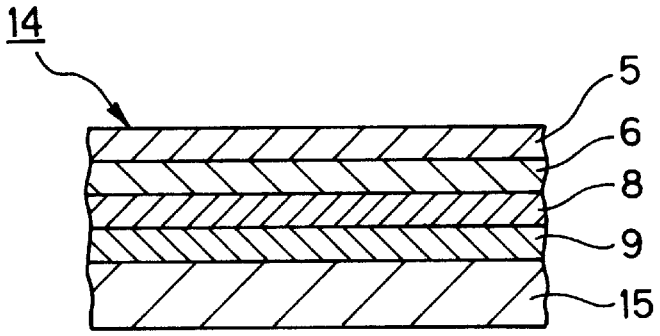
FIG. 2 is a sectional view of a printed product formed by the transfer from the integrated thermal transfer sheet of the present invention.

FIG. 2 is a sectional view of a printed product 14 formed by the transfer from the thermal transfer sheet 1 of the present invention. The printed product 14 is formed by performing the transfer of the receptor layer-transfer portion 11, the dye layer-transferring portion 12 and the white layer-transferring portion 13 in this order from the thermal transfer sheet 1 to the transfer receiving material 15 so that a multilayered structure, which comprises an adhesive layer 9/a receptor layer 8 (including an image which is not shown)/a white layer 6/a peeling layer 5 in this order, is formed.

As illustrated in FIG. 1, since the thermal transfer sheet 1 has the receptor layer 8, the dye layer 4 and the white layer 6 on the same substrate sheet 2, all of the necessary layers can be transferred to the transfer receiving material 15 in a continuous thermal transfer process.

The receptor layer 8 having excellent dyeability is separated at the boundary with the release layer 7 well adhering to the substrate sheet 2, and is then transferred via the adhesive layer 9 to the transfer receiving material 15. The presence of the receptor layer 8 makes it possible to form an image also on the transfer receiving material 15 having poor dyeability. If the transfer receiving material 15 has good dyeability, an image can be formed directly on the transfer receiving material 15 without forming the receptor layer 8.

The dye layer 4 is required to transfer the sublimation dye alone contained therein to the receptor layer 8 so that the binder resin is retained on the substrate sheet 2. For this purpose, the adhesion between the dye layer 4 and the substrate sheet 2 may be enhanced by subjecting the substrate sheet 2 to a treatment which improves the adhesion of the substrate sheet 2. On the other hand, the receptor layer 8 is required to be easily peelable from the substrate sheet 2 so that it is transferred to the transfer receiving material 15. Therefore, the presence of the release layer 7 between the substrate sheet 2 whose surface is treated to improve adhesion and the receptor layer 8 facilitates the transfer of the receptor layer 8 to the transfer receiving material 15. Alternatively, the receptor layer 8 may contain a specific amount of an release agent as described later in order to increase the peelability of the receptor layer 8 itself.

After the transfer of the receptor layer 8, an image or a letter is formed by successive transfer of the sublimation dyes contained in the dye layers 4, i.e., yellow dye layer, magenta dye layer and cyan dye layer, disposed side by side on the same surface of the thermal transfer sheet 1 to the receptor layer 8 by means of thermal transfer. In this case, if necessary, a black dye layer may also be disposed. Since the dye layers 4 are disposed on and adhere to the substrate sheet 2 whose adhesion is improved by the treatment, the sublimation dyes are well transferred to the receptor layer 8 and, as a result, an image having excellent gradation can be formed.

Onto the receptor layer 8 having an image formed therein is transferred a white layer 6 formed on the same surface of the thermal transfer sheet 1 together with an peeling layer 5 by means of thermal transfer. Since the white layer 6 contains a substance capable of adhering to the receptor layer 8 or the transfer receiving material 15, the adhesion to the receptor layer 8 or the transfer receiving material 15 can be secured even if the white layer 6 is transferred directly to the receptor layer 8 or the transfer receiving material 15. Therefore, in contrast with a conventional practice, the white layer 6 can be transferred directly to the receptor layer without an adhesive layer interposed therebetween. Further, as described later, adhesion and white screenability of the white layer 6 can be adjusted by bringing the ratio of the substance capable of adhering to the receptor layer 8 or the substrate sheet 2 to the white pigment within a proper range.

In order to further improve the white screenability, it is also possible to incorporate a white pigment into the peeling layer 5 which is transferred concurrently with the white layer 6. If an attempt to improve the adhesion of the white layer 6 reduces the proportion of the white pigment and leads to the lack of white screenability, the incorporation of the white pigment into the peeling layer 5 can effectively supplement the screenability.

As stated above, according to the present invention, a dye layer-transferring portion 12 and a white layer-transferring portion 13 are alternately disposed side by side on the same substrate sheet 2 if a transfer receiving material 15 has good dyeability, while a receptor layer-transferring portion 11, a dye layer-transferring portion 12 and a white layer-transferring portion 13 are alternately disposed side by side on the same substrate sheet 2 if a transfer receiving material 15 has poor dyeability. Accordingly, the present invention makes it possible to manufacture a printed product 14 efficiently in a series of transfer steps. Further, the present invention brings about the advantages that dust can be prevented from mingling in during the transfer steps, that the manufacture of the printed product 14 is easy and that the down-sizing and cost reduction of a printer and the like for use in the transferring operations are possible. Furthermore, the present invention makes it possible to manufacture an inexpensive thermal transfer sheet 1 having no adhesive layer which has been hitherto necessary and to provide a printed product 14 having excellent white screenability, because the white screenability of the white layer 6 can be maintained or improved while upholding the adhesive capacity of the white layer 6 by adjusting the proportion between an adhesive substance and the white pigment in the white layer 6 and by incorporating the white pigment into the peeling layer 5.

Details of the processes for forming layers constituting the thermal transfer sheet 1 of the present invention and the process for manufacturing the thermal transfer sheet 1 are given below.

[Substrate Sheet]

The substrate sheet 2 is first described below. If necessary, the substrate sheet 2 may be surface-treated to improve adhesion, or may have a heat resistant layer 3.

A material of the substrate sheet 2 for use in the thermal transfer sheet 1 may be any of known materials in so far as the material has a certain level of heat resistance and strength. The material is in the shape of a film or a sheet having a thickness in the range of 0.5 to 50 $\mu$m and preferably in the range of 3 to 10 $\mu$m. Examples of the material include paper, various kinds of processed paper, polyester film, polystyrene film, polypropylene film, polysulfone film, aramid film, polycarbonate film, polyvinyl alcohol film, and cellophane. In particular, polyester film is preferable.

Where the adhesion between the substrate sheet 2 and the dye layer 4 formed thereon is weak, it is desirable that the surface of the substrate sheet 2 be coated with a primer or treated with corona discharge in order to improve the adhesion. Further, in the case where the peeling layer 5 of a white layer-transferring portion 13 undergoes cohesive failure so that the white layer is transferred to the transfer receiving material 15 as described later, the adhesion between the substrate sheet 2 and the peeling layer 5 is also required to be strong. Therefore, preferably the substrate sheet 2 is surface-treated to improve the adhesion.

[Heat Resistant Layer]

A heat resistant layer 3 which is formed, if necessary, on the thermal transfer sheet 1 brings about the advantage that adverse effects, i.e., sticking, print-void like wrinkle and the like, due to the heat of a thermal head which is brought into contact with the back side of the thermal transfer sheet 1 at the time of transfer, can be prevented.

A known resin may be used for forming the heat resistant layer 3. Examples of the resin include a polyvinyl butyral resin, a polyvinyl acetoacetal resin, a polyester resin, a vinyl chloride/vinyl acetate copolymer, a polyether resin, a polybutadiene resin, a styrene/butadiene copolymer, acrylic polyol, polyurethane acrylate, polyester acrylate, polyether acrylate, epoxy acrylate, a prepolymer of urethane or epoxy, a nitrocellulose resin, a cellulose nitrate resin, a cellulose acetopropionate resin, a cellulose acetobutylate resin, a cellulose acetate hydrogenphthalate resin, a cellulose acetate resin, an aromatic polyamide resin, a polyimide resin, a polycarbonate resin, and a chlorinated polyolefin resin.

Examples of a slipping agent, which is added to or coated on the heat resistant layer 3, include phosphoric acid ester, silicone oil, graphite powder, a silicone-based graft polymer, a fluorine-containing graft polymer, an acryl-containing silicone graft polymer, and a silicone polymer such as acryl-siloxane or aryl-siloxane. The heat resistant layer 3 is preferably composed of a polyisocyanate of polyol e.g., an alcoholic polymer and phosphoric acid ester. More preferably, the heat resistant layer 3 contains a filler.

The heat resistant layer 3 can be formed by a process comprising the steps of preparing a coating liquid to form the heat resistant layer by dissolving or dispersing the above resin, the slipping gent and optionally the filler in an appropriate solvent, coating the other side (the side where a dye layer, etc. are not formed) of the substrate sheet 2 with the coating liquid by such means as gravure printing, screen printing, reverse coating using a gravure plate, or the like, and drying the coated layer.

[Dye Layer]

Details of the dye layer-transferring portion 12 are given below. The dye layer 4 for use in the thermal transfer sheet 1 is prepared by the use of a coating liquid comprising a sublimation dye, a binder resin, and other optional ingredients such as an organic filler.

The sublimation dye for use in the present invention is not limited to a specific one, and a known sublimation dye can be used. Some preferable examples of the sublimation dye are as follows. Examples of a magenta dye are MS Red G, Macrolex Red Violet R, Ceres Red 7B, Samaron Red HBSL, Resolin Red F3BS, etc. Examples of a yellow dye are Phorone Brilliant Yellow 6GL, PTY-52, Macrolex Yellow 6G, etc. Examples of a cyan dye are Kayaset Blue 714, Waxoline Blue AP-FW, Phorone Brilliant Blue S-R, MS Blue 100, etc.

The binder resin designed to hold the sublimation dye is not limited to a specific one, and a known binder resin can be used. Some preferable examples of the binder resin include a cellulosic resin such as ethyl cellulose, hydroxyethyl cellulose, ethyl hydroxycellulose, hydroxypropylcellulose, methyl cellulose, cellulose acetate, or cellulose acetobutyrate; a vinyl resin such as polyvinyl alcohol, polyvinyl acetate, polyvinyl butyral, a polyvinyl acetal, polyvinyl pyrrolidone, or polyacrylamide; and a polyester resin.

Further, in order to improve the releasability of the dye layer 4 at the time of transfer, the binder resin may be a graft copolymer having at least one releasability-imparting segment selected from the group consisting of a polysiloxane segment, a fluorocarbon segment, and a long-chain alkyl segment each of which is grafted to the main chain of a resin such as an acrylic resin, a vinyl resin, a polyester resin, a polyurethane resin, a polyamide resin, or a cellulosic resin.

The organic filler contained in the dye layer 4 may be of any kind in so far as it is well wettable with the coating liquid to form the dye layer. The filler may be made from any of the following polymeric materials or may be made from a composition mainly composed of any of the following polymeric materials. The polymeric materials are, for example, a phenolic resin, a melamine resin, a urethane resin, an epoxy resin, a silicone resin, a urea resin, a dially phthalate resin, an alkyd resin, an acetal resin, an acrylic resin, a methacrylic resin, a polyester resin, a cellulosic resin, starch or a derivative thereof, polyvinyl chloride, polyvinylidene chloride, chlorinated polyethylene, a fluorocarbon resin, polyethylene, polypropylene, polystyrene, polyvinyl acetal, polyamide, polyvinyl alcohol, polycarbonate, polysulfone, polyether sulfone, polyphenylene oxide, polyphenylene sulfide, polyether ether ketone, polyamino-bismaleimide, polyarylate, polyethylene terephthalate, polybutylene terephthalate, polyethylene naphthalatepolyimide, polyamidimide, polyacrylonitrile, an AS resin, an ABS resin, and a SBR resin.

A coating liquid utilizing a typical combination of a wettable organic filler and a binder for the formation of the dye layer is a coating liquid comprising a polyethylene filler or a Fischer-Tropsch wax as an organic filler and polyvinyl acetoacetal as a binder resin.

The thickness of the dye layer 4 is preferably 0.2 to 3 $\mu$m, more preferably 0.3 to 2 $\mu$m, as a dry layer.

The dye layer 4 can be formed by a process comprising the steps of preparing a coating liquid to form the dye layer by dissolving or dispersing the sublimation dye, the binder resin, and an optional ingredient in an appropriate solvent and thereafter dispersing an organic filler in the resulting coating liquid, applying the thus obtained coating liquid on the substrate sheet 2 by such means as gravure printing, screen printing, reverse coating using a gravure plate, or the like, and drying the coated layer.

[White Layer]

The details of the white layer-transferring portion 13 are given below. The white layer-transferring portion 13 comprises a white layer 6, which is designed to impart a proper light diffusivity and a proper light transmissivity to the printed product 14, and a peeling layer 5 which is designed to smoothly peel the white layer 6 from the substrate sheet 2.

The white layer 6 for use in the thermal transfer sheet 1 of the present invention comprises a white pigment designed to impart a light-diffusing property to the white layer 6 and a binder resin. According to the present invention, the white layer 6 may utilize as a binder resin an adhesive resin which enables the white layer 6 to adhere directly to the transfer receiving material without interposing an adhesive layer therebetween, or alternatively the white layer may contain an adhesive together with the white pigment and the binder resin.

In addition to a typical white pigment, the white pigment for use in the present invention may be a filler. Accordingly, the white pigments for use in the present invention include a filler. These white pigments and/or fillers are hard solid particles. Examples of these particles include a typical white pigment such as titanium oxide or zinc oxide; an inorganic filler such as silica, alumina, clay, talc, calcium carbonate or barium sulfate; and particles of a resin (plastic pigment) such as an acrylic resin, an epoxy resin, a polyurethane resin, a phenolic resin, a melamine resin, a benzoguanamine resin, a fluorocarbon resin or a silicone resin. As to the titanium oxide, any of rutile titanium oxide and anatase titanium oxide may be used.

Examples of the adhesive resin include an acrylic resin, a polyamide resin and a vinyl chloride/vinyl acetate copolymer. Among these resins, an acrylic resin is preferred. Specific examples of the acrylic resin include polymethyl methacrylate, polyethyl methacrylate and polyethyl acrylate.

Where an adhesive is used together with a binder resin, the binder resin may be a known binder resin. Examples of such a binder resin include a cellulosic resin, a polyester resin, a vinyl resin, a polyurethane resin, a polycarbonate resin, and a resin prepared by partial cross-linking of any of the foregoing resins.

A thermoplastic resin, a naturally occurring resin, rubber, or wax, which is a material conventionally used for forming an adhesive layer on a white layer or a receptor layer, can be used as an adhesive to be incorporated into the white layer 6. Examples of these materials include a cellulosic derivative such as ethyl cellulose or cellulose acetobutyrate; a styrenic polymer such as polystyrene or poly $\alpha$-methylstyrene; an acrylic resin such as polymethyl methacrylate, polyethyl methacrylate or polyethyl acrylate; a vinyl resin such as polyvinyl chloride, polyvinyl acetate, a vinyl chloride/vinyl acetate copolymer or polyvinyl butyral; a polyester resin; a polyamide resin such as nylon; an epoxy resin; a polyurethane resin; an ionomer; other synthetic resin such as an ethylene/acrylic acid copolymer, an ethylene/acrylate copolymer or the like; rosin as a tackifier; a rosin-modified maleic acid resin; ester gum; a rubber such as polyisobutylene rubber, butyl rubber, styrene/butadiene rubber, butadiene/acrylonitrile rubber or the like; and a polychlorinated olefin. These materials may be used alone or in a combination of two or more of them.

The white layer 6 may contain a fluorescent whitening agent in addition to the white pigment and/or the filler and the binder resin. A known compound having a fluorescent whitening effect such as stilbene or pyrazoline may be used as the fluorescent whitening agent. Further, the white layer 6 may contain some coloring agents.

In the case where the printed product 14 having the white layer 6 used for the thermal transfer sheet 1 transferred thereto is enjoyed by use of the transmitted light from back light, the white layer 6 needs to have a proper light diffusivity and a proper light transmissivity. On the other hand, in the case where the printed product 14 having the white layer 6 transferred thereto is enjoyed by use of the reflected light with which the printed product 14 is illuminated from the front, the white layer 6 needs to have a proper light diffusivity and a proper light reflectivity. In both cases, the white layer 6 needs to contain a white pigment in an amount above a certain level so as to obtain a proper light diffusivity, although the latter case needs a larger amount of the white pigment in comparison with the former case.

Besides, in the present invention, in order that the white layer itself can exhibit an adhesive capacity, the white layer needs to contain an adhesive binder resin or an adhesive in an amount above a certain level.

From this standpoint, it is important to adjust the ratio between the amount of the adhesive binder resin or the adhesive and the amount of the white pigment. For example, in the case of the white layer to be back-lighted, a weight ratio (A/B) of the amount (A) of the adhesive binder resin (preferably an acrylic resin) or the total amount (A) of the binder resin and the adhesive to the amount (B) of the white pigment is preferably within the range of 1/1 to 1/10. Most preferably the ratio (A/B) ranges from 1/5 to 1/1. The ratio (A/B) is set to a value within the range depending on the material of the transfer receiving material 15 or the receptor 8 to which the white layer 6 is transferred. If the ratio (A/B) exceeds 1/1, the white screenability may be reduced, whereas if the ratio (A/B) drops below 1/10 due to a large amount of the white pigment, the adhesive capacity may become short.

The thickness of the white layer 6 is usually about 0.5 to 2.0 $\mu$m, as a dry layer.

[Peeling Layer]

The peeling layer 5 for use in the thermal transfer sheet 1 of the present invention constitutes the white layer-transferring portion 13 jointly with the white layer 6, and the peeling layer 5 is disposed between the substrate sheet 2 and the white layer 6. The peeling layer 5 is formed to prevent the thermal fusion between the thermal transfer sheet 1 and the transfer receiving material 15 and to facilitate the uniform transfer of the white layer 6 onto the receptor layer 8 disposed on the transfer receiving material 15.

The peeling layer 5 may be, for example, a releasable peeling layer which is separated at the boundary with the substrate sheet 2, or may be a cohesive peeling layer which is separated from the substrate sheet 2 by causing a cohesive failure within the peeling layer 5.

The releasable peeling layer can be prepared by adding, if necessary, a releasing substance to a binder resin. Examples of employable binder resins include a thermoplastic resin such as an acrylic resin, e.g., polymethyl methacrylate, polyethyl methacrylate or polybutyl acrylate; a vinyl resin, e.g., polyvinyl acetate, a vinyl chloride/vinyl acetate copolymer, polyvinyl alcohol or polyvinyl butyral; a cellulosic derivative, e.g., ethyl cellulose, nitrocellulose or cellulose acetate; and a thermosetting resin such as an unsaturated polyester resin, a polyester resin, a polyurethane resin, and an aminoalkyd resin. These resins may be used alone or in a combination of two or more of them to form the releasable peeling layer.

Examples of the releasing substance include a resin having a releasability such as wax, silicone wax, silicone oil, a silicone resin, a melamine resin, or a fluorocarbon resin; particles of talc or silica; and a slicking agent such as a surfactant or a metal soap.

The releasable peeling layer can also be prepared by using a resin having a releasability. Examples of employable resins for this purpose include a silicone resin, a melamine resin and a fluorocarbon resin. Also employable is a graft polymer prepared by grafting a releasing segment such as a polysiloxane segment, a fluorocarbon segment or the like to the molecule of a resin such as an acrylic resin, a vinyl resin or a polyester resin. These resins may be used alone or in a combination of two or more of them. The releasable peeling layer may contain a conventionally known fluorescent whitening agent such as stilbene or pyrazoline in addition to the above-described materials.

When the white layer transferring portion 13 is transferred to the receptor layer 8, the tearable peeling layer undergoes so-called cohesive failure approximately in the middle of the layer in the direction of the thickness of the peeling layer 5 such that part of the peeling layer 5 remains on the substrate sheet 2 and the rest of the peeling layer 5 is transferred onto the printed product 14. If the tearable peeling layer undergoes cohesive failure and part of its layer is transferred onto a transfer receiving material, irregularity of the torn peeling layer is formed on the uppermost surface (back side) of the printed product 14. The surface irregularity thus formed on the uppermost surface (back side) of the printed product 14 diffuses and reflects the light radiated, for example, from the electric power source for an electric decorating display. Accordingly, the diffusion and the reflection thus created supplement the light diffusivity of the white layer 6 and contributes to the formation of an attractive electric decorating display characterized by good diffusivity and transmissivity of light.

The cohesive peeling layer 5 can be prepared by adding, if necessary, a releasing substance to a binder resin. Examples of employable binder resins include a thermoplastic resin such as an acrylic resin, e.g., polymethyl methacrylate, polyethyl methacrylate or polybutyl acrylate; a vinyl resin, e.g., polyvinyl acetate, a vinyl chloride/vinyl acetate copolymer, polyvinyl alcohol or polyvinyl butyral; a cellulosic derivative, e.g., ethyl cellulose, nitrocellulose or cellulose acetate; a polyester resin; and a polyurethane resin. These resins may be used alone or in a combination of two or more of them. In order to prevent the thermal fusion between the binder resin and the substrate sheet 2 at the time of thermal transfer, it is desirable that the binder resins comprise a resin having glass-transition temperature(Tg) or a softening point of 100° C. or above. A resin having Tg or a softening point of below than 100° C. can also be used if an appropriate releasing substance is used together with the resin.

Examples of the releasing substance include waxes, inorganic particles such as talc or silica, and organic particles. The amount added of the releasing substance is preferably 0.1 to 200% by weight, more preferably 10 to 100% by weight, calculated with respect to the amount of the binder resin.

If the releasing substance is not used for the preparation of the cohesive peeling layer 5, the peeling layer 5 may comprise at least two binder resins selected from the above-mentioned binder resins such that the selected binder resins have poor compatibility with each other. The peeling layer 5 composed of the binder resins thus selected can be torn and hence separated at the interface between the binder resins constituting the peeling layer 5.

The white screenability can be improved by the incorporation of a white pigment into the peeling layer 5. As stated previously, since the white layer 6 contains an adhesive binder resin such as an acrylic resin or an adhesive in a predetermined proportion, an attempt to enhance the adhesive capacity of the white layer 6 will inevitably reduce the proportion of the white pigment and therefore the white screenability may become insufficient. Accordingly, the use of the thermal transfer sheet 1, in which the white screenability of the white layer 6 is supplemented by the white pigment incorporated in the peeling layer 5, can provide the printed product 14 having a sufficient white screenability by thermal transfer.

Titanium oxide, zinc oxide or the like can also be used as a white pigment for the peeling layer 5. Although the content of the white pigment cannot be stipulated unqualifiedly because the content of the white pigment is selected depending on the white screenability of the white layer 6, the content of the white pigment is usually 100 to 500% by weight, preferably 200 to 300% by weight, calculated with respect to the amount of the binder resin constituting the peeling layer 5.

The peeling layer 5, which is either a releasable peeling layer or a tearable peeling layer as described above, may contain, in addition to the above-mentioned ingredients, an ultraviolet absorbent to improve weather resistance, an antioxidant, a fluorescent whitening agent (stilbene, pyrazoline or the like), etc.

The peeling layer 5 can be formed by the same process as in the formation of the dye layer 4. The thickness of the peeling layer 5 is preferably 0.1 to 5.0 $\mu$m, as a dry layer.

[Receptor Layer]

The details of the receptor layer-transferring portion 11 are given below. The receptor layer-transferring portion 11 is disposed on the thermal transfer sheet 1 together with the dye layer-transferring portion 12 and the white layer-transferring portion 13 in the case where the dyeability of the transfer receiving material 15 is poor. After being transferred to the transfer receiving material 15, the receptor layer facilitates the image formation and provides an excellent image. The receptor layer-transferring portion 11 comprises a release layer 7, a receptor layer 8 and an adhesive layer 9, stacked in this order, on the substrate sheet 2. The receptor layer-transferring portion 11 may be absent on the substrate sheet 2 if the dyeability of the transfer receiving material 15 is good.

The receptor layer 8 for use in the thermal transfer sheet 1 can be formed by overlaying the release layer 7 with a resin which dyes easily by the aforementioned sublimation dye.

Examples of the resin suited for the formation of the receptor layer 8 include a polyolefinic resin such as polypropylene; a halogenated polymer such as polyvinyl chloride or polyvinylidene chloride; a vinyl polymer such as polyvinyl acetate, a vinyl chloride/vinyl acetate copolymer, an ethylene/vinyl acetate copolymer or a polyacrylate; a polystyrene resin; a polyamide resin; a copolymer produced by the copolymerization of an olefin such as ethylene or propylene with other vinyl monomer; an ionomer; a cellulosic resin such as cellulose diacetate; and polycarbonate. Among these resins, particularly preferred are a vinyl chloride resin, an acrylic/styrene resin and a polyester resin.

The receptor layer 8 can be formed by a process comprising the steps of preparing a coating liquid by dissolving or dispersing the single or plural resins selected from the above-mentioned scope, and, as necessary, conventionally known additives in an appropriate solvent, applying the coating liquid on the release layer 7 by such means as gravure printing, screen printing, reverse coating using a gravure plate, or the like, and drying the coated layer. The thickness of the receptor layer 8 is about 1 to 10 $\mu$m, as a dry layer.

Preferably, a release agent, such as a reaction-curable silicone compound, e.g., vinyl-modified silicone, amino-modified silicone or epoxy-modified silicone, is used as an additive. This type of release agent facilitates the peelability of the receptor layer 8 from the release layer 7 at the boundary therebetween when the receptor layer 8 is transferred to the transfer receiving material 15 and prevents the thermal fusion between the receptor layer 8 and the dye layer 4 by the heat of the thermal head and the like when an image is transferred to the receptor layer 8. The amount added of the release agent is preferably 0.5 to 10% by weight calculated with respect to the amount of the binder resin in the receptor layer.

Further, in order to improve the image printing sensitivity of the receptor layer 8, a conventional plasticizer for a vinyl resin, which plasticizer is exemplified by phthalate, phosphate or a polyester-based plasticizer and has a molecular weight ranging from a low molecular weight to a high molecular weight, can be added to the receptor layer 8. The amount added of the plasticizer is preferably 0.5 to 30% by weight calculated with respect to the amount of the resin in the receptor layer.

[Release Layer]

In the thermal transfer sheet 1 of the present invention, the release layer 7 is interposed between the substrate sheet 2 and the receptor layer 8 so as to facilitate the peelability of the receptor layer 8 from the release layer 7 at the boundary therebetween.

Examples of the preferable material for use in the formation of the release layer 7 include a butyral resin, polyvinyl alcohol (PVA) resin and a urethane resin. The release layer 7 comprises at least one of these resins.

The release layer 7 can be formed by a process comprising the steps of preparing a coating liquid by dissolving or dispersing the resin in an appropriate solvent, applying the coating liquid on the substrate sheet 2 by such means as gravure printing, screen printing, reverse coating using a gravure plate, or the like, and drying the coated layer. The coated weight is usually 0.05 to 2 g/m$^2$ as a dry layer.

[Adhesive Layer]

In the thermal transfer sheet 1 of the present invention, the adhesive layer 9 is disposed so as to improve the adhesion of the receptor layer 8 to the transfer receiving material 15 when the receptor layer 8 is transferred to the transfer receiving material 15. Examples of the material constituting the adhesive layer 9 include a polyacrylate and an acrylic copolymer. If necessary, a reinforcement agent, a plasticizer, a filler and the like may also be added.

The adhesive layer 9 can be formed by a process comprising the steps of preparing a coating liquid by dissolving or dispersing the material and optionally the reinforcement agent and the like in an appropriate solvent, applying the coating liquid on the receptor layer 8 by a conventionally known method, and drying the coated layer. The coated weight is usually 0.5 to 5 g/m$^2$ as a dry layer.

[Detection Mark]

A detection mark can be disposed, for example, as a mark which enables the receptor layer-transferring portion 11 to be transferred to a specified site on the transfer receiving material 15 in a printer, or which enables sublimation dyes of different colors to be transferred onto the receptor layer 8 present on the transfer receiving material 15 without causing site deviation or color deviation, or which enables the white layer-transferring portion 13 to be transferred to a specified site on the image formed.

The detection mark may be in any shape in so far as it is optically detectable. For example, the detection mark may be a conventionally known one such as a printed mark in the shape of a circle, a square, a line or the like, or alternatively a through hole. The printed detection mark by printing may be disposed at one site or at plural sites on one of the sides of the substrate sheet 2 of the thermal transfer sheet 1 by a conventionally known printing method. When the detection mark is formed by printing, the ink to be used for this purpose is not particularly limited and a conventional ink may be used.

As stated above, since all necessary layers and images can be transferred in a continuous transfer process according to the thermal transfer sheet 1 and the method of the present invention, the printed product can be manufactured efficiently. In addition, the thermal transfer sheet 1, whose number of layers is reduced and whose cost is less expensive in comparison with a conventional thermal transfer sheet, leads to a printed product 14 having excellent qualities such as better white screenability in comparison with a conventional thermal transfer sheet. Further, since the thermal transfer sheet 1 can produce a printed product 14 having a distinct photographic image when viewed from the side of the transparent transfer receiving material, the thermal transfer sheet 1 can be effectively used for, for example, the production of electric decorating displays and lenticular lenses, proof in the printing of wrapping materials, and the production of printed products for presentation.

EXAMPLES

The thermal transfer sheet of the present invention and the method for manufacturing it are specifically explained below.

Firstly, coating liquids to form the layers of the thermal transfer sheet 1 were prepared according to the following compositions.

| <Coating Liquid for Heat Resistant Layer> | |
|---|---|
| Polyvinyl butyral resin (ESLEC BX-1: manufactured by Sekisui Chemical Co., Ltd.) | 3.6 parts by weight |
| Polyisocyanate (BARNOCK D750: manufactured by Dainippon Ink Chemicals Co., Ltd) | 8.6 parts by weight |
| Phosphate-based surfactant (PLYSURF A208S: Daiichi Kogyo Seiyaku Co., Ltd.) | 2.8 parts by weight |
| Talc (MICROACE P-3: manufactured by Nippon Talc Co., Ltd.) | 0.7 parts by weight |
| Methyl ethyl ketone | 32.0 parts by weight |
| Toluene | 32.0 parts by weight |

<Coating Liquids for Dye Layer>

(Yellow Ink)

| | |
|---|---|
| Disperse dye (Phorone brilliant yellow S-6GL) | 5.5 parts by weight |
| Binder resin (Polyvinyl acetoacetal resin KS-5: manufactured by Sekisui Chemical Co., Ltd.) | 4.5 parts by weight |
| Polyethylene wax | 0.1 parts by weight |
| Methyl ethyl ketone | 45.0 parts by weight |
| Toluene | 45.0 parts by weight |

(Magenta Ink)

Magenta ink had the same composition as that of the yellow ink, except that the disperse dye of the yellow ink was replaced with 1.5 parts by weight of MS red and 2.0 parts by weight of Macrolex red violet R.

(Cyan Ink)

Cyan ink had the same composition as that of the yellow ink, except that the disperse dye of the yellow ink was replaced with 4.5 parts by weight of Kayaset blue 714.

-continued

| <Coating Liquid for Peeling Layer> | |
|---|---|
| Acrylic resin (LP-45M: manufactured by Soken Chemical Co., Ltd.) | 16 parts by weight |
| Polyethylene wax (average particle size: about 1.1 μm) | 8 parts by weight |
| Toluene | 76 parts by weight |

| <Coating Liquid for White Layer> | |
|---|---|
| Modified acrylic resin (ACRYDICK BZ-1160: manufactured by Dainippon Ink Co., Ltd.) | 20 parts by weight |
| Anatase-type titanium oxide (TCA888: manufactured by Tochem Products Co., Ltd.) | 40 parts by weight |
| Fluorescent whitening agent (UVITEX OB: manufactured by Ciba-Geigy Corp.) | 0.3 parts by weight |
| Toluene/Isopropyl alcohol (1/1 by weight) | 40 parts by weight |

| <Coating Liquid for Release Layer> | |
|---|---|
| Polyurethane resin (CRYSBON 9004: manufactured by Dainippon Ink Co., Ltd.) | 100 parts by weight |
| Polyvinyl acetal resin (KS-5: manufactured by Sekisui Chemical Co., Ltd.) | 30 parts by weight |
| Dimethylformamide/methyl ethyl ketone (1/1 by weight) | 300 parts by weight |

| <Coating Liquid for Receptor Layer> | |
|---|---|
| Vinyl chloride/vinyl acetate copolymer resin (DENKALAC 1000A: manufactured by Kenki Kagaku Kogyo Co., Ltd.) | 100 parts by weight |
| Epoxy-modified silicone (KF-393: manufactured by Shin-Etsu Chemical Co., Ltd.) | 3 parts by weight |
| Amino-modified silicone (KF-343: manufactured by Shin-Etsu Chemical Co., Ltd.) | 3 parts by weight |
| Methyl ethyl ketone/toluene (1/1 by weight) | 400 parts by weight |

| <Coating liquid for Adhesive Layer> | |
|---|---|
| Vinyl chloride/vinyl acetate copolymer resin (1000ALK: manufactured by Kenki Kagaku Kogyo Co., Ltd.) | 50 parts by weight |
| Copolymer resin having a reactive ultraviolet absorbent chemically linked thereto (UVA-635L: manufactured by BASF Japan Co., Ltd.) | 50 parts by weight |
| Methyl ethyl ketone/toluene (1/1 by weight) | 400 parts by weight |

Example 1

A polyethylene terephthalate (PET) film having a thickness of 6 μm, whose one side was surface-treated to improve adhesion, was used as the substrate sheet 2. The other side of the substrate sheet 2 was coated with the coating liquid for heat-resistant layer by means of a gravure printing machine, and the coating was dried to form a heat-resistant layer 3 having a thickness of 1 μm. Further, the layer was hardened by aging in an oven at 60° C. for 5 days.

The yellow ink, the magenta ink and the cyan ink were applied by means of a gravure printing machine side by side on the surface-treated side 10 of the substrate sheet 2, the coating was dried to form a dye layer 4 having a thickness of 1 μm.

Next, a peeling layer 5 having a thickness of 0.6 μm was formed by applying the coating liquid for peeling layer by means of a gravure printing machine on the substrate sheet 2 by the side of the dye layer 4, and drying the resulting coating. Then, a white layer 6 having a thickness of 2.0 μm was formed by applying the coating liquid for white layer by means of a gravure printing machine on the peeling layer 5, and drying the resulting coating. In this way, the thermal transfer sheet of the present invention was prepared.

By using the thermal transfer sheet obtained, an image and the white layer 6 were transferred onto the receptor layer which had been formed in advance on a polyvinyl chloride (PVC) sheet. That is, a printed product was manufactured by a process comprising the steps of bringing the thermal transfer sheet into face to face contact with the receptor layer formed on the PVC sheet, forming a color image by transferring dyes from the dye layer 4 containing, respectively, yellow, magenta and cyan dyes by means of a printer mounted with a thermal head having a line density of 300 dpi and capable of controlling 256 gradations, and transferring the white layer 6 onto the receptor layer provided with the image.

Example 2

A receptor layer-transferring portion 11 was formed at the site indicated in FIG. 1 on the thermal transfer sheet 1 prepared in Example 1. That is, a release layer 7 was formed by applying the coating liquid for release layer at a rate that provided after drying thereof a coated weight of 0.3 g/m$^2$ by means of a gravure printing machine by the side of the dye layer 4 of the thermal transfer sheet 1 of the Example 1, and drying the resulting coating. Then, a receptor layer 8 having a thickness of 2 $\mu$m was formed by applying the coating liquid for receptor layer by means of a gravure printing machine on the release layer 7, and drying the resulting coating. Finally, an adhesive layer 9 was formed by applying the coating liquid for adhesive layer at a rate that provided after drying thereof a coated weight of 2 g/m$^2$ by means of a gravure printing machine on the receptor layer 8, and drying the resulting coating. In this way, as shown in FIG. 1, the thermal transfer sheet having the receptor layer-transferring portion 11 of the present invention was prepared.

By using the thermal transfer sheet 1 obtained, an image was thermally transferred onto a PVC sheet, a PET sheet and an ABS sheet none of which had a receptor layer by means of the same printer as in Example 1. That is, the receptor layer 8 was first transferred from the thermal transfer sheet 1 and well adhered to each card via the adhesive layer 9 present therebetween. Then, dyes were transferred from the dye layer 4 containing, respectively, yellow, magenta and cyan dyes to the receptor layer 8 to thereby form a color image. Finally, the adhesive white layer 6 and the peeling layer 5 were transferred onto the receptor layer 8 provided with the image. In this way, a printed product 14 was prepared.

Comparative Example 1

By using the thermal transfer sheet obtained in Example 1, a color image was formed by transferring yellow, magenta and cyan dyes directly onto a PVC sheet which had no receptor layer.

Comparative Example 2

By using the thermal transfer sheet obtained in Example 1, a color image was formed by transferring yellow, magenta and cyan dyes directly onto a PET sheet and an ABS sheet neither of which had a receptor layer.

<Evaluation of Transferability and Image Formed>

The transferability of each layer was visually inspected in the printed products prepared in examples and comparative examples. The quality of each image formed by transfer was also visually inspected. The results are shown in Table 1.

TABLE 1

| | Material of Transfer Receiving sheet | Transferability to Transfer Receiving sheet | Quality of Image Formed by Transfer |
|---|---|---|---|
| Examples | | | |
| 1 | PVC | Good | Good |
| 2 | PVC | Good | Good |
| | PET | Good | Good |
| | ABS | Good | Good |
| Comparative Examples | | | |
| 1 | PVC | Good | Blurred |
| 2 | PET | Abnormal | No good |
| | ABS | Abnormal | No good |

In Example 1, because a receptor layer having excellent dyeability was disposed in advance on the PVC sheet constituting a transfer receiving material, dyes of the dye layer 4, and the white layer 6 and the peeling layer 5 could be easily transferred. The image formed by the transfer was excellent. In Example 2, because the receptor layer 8 disposed on the thermal transfer sheet 1 was first transferred to the transfer receiving material 15 and thereafter dyes of the dye layer 4, and the white layer 6 and the peeling layer 5 were transferred, the transferability and the image formed by the transfer were both excellent.

To the contrary, because the dye ability of the PVC sheet constituting the transfer receiving material of Comparative Example 1 was inferior to that of the PVC sheet having a receptor layer disposed thereon, Comparative Example 1 produced a blurred image. In Comparative Example 2, because the dyeability of the PET sheet and the ABS sheet, each constituting the transfer receiving material, was poor, the image could not be transferred well.

As stated above, the use of the integrated thermal transfer sheet of the present invention comprising at least a dye layer, a white layer and optionally a receptor layer as well as a method for forming the thermal transfer sheet makes it possible to manufacture a printed product efficiently in a series of transfer steps, because the necessary layers are alternately disposed side by side on the same substrate sheet. Further, the present invention brings about the advantages that dust can be prevented from mingling in during the transfer steps, that the manufacture of the printed product is easy and that the down-sizing and cost reduction of a printer for transfer operations is possible. Furthermore, the present invention makes it possible to manufacture an inexpensive thermal transfer sheet having no adhesive layer which has been hitherto necessary and to provide a printed product having excellent white screenability, because the white screenability of the white layer can be maintained or improved while upholding the adhesive capacity of the white layer by adjusting the proportion between an adhesive substance and the white pigment in the white layer and by the incorporation of the white pigment into the peeling layer.

What is claimed is:

1. A method of manufacturing a printed product to be observed by transmission light from back side, comprising the steps of:

preparing a thermal transfer sheet comprising a substrate sheet, a dye layer of at least one color and a white layer to cover an image-receiving portion of a receiving material after an image is formed thereto, the dye layer and the white layer being alternately disposed side by side on a surface of the substrate sheet, wherein the white layer comprises an adhesive binder resin and a white pigment at a ratio (A/B) of an amount (A) of the adhesive binder resin to an amount (B) of the white pigment within a range of 1/1 to 1/10 or comprises a binder resin, an adhesive and a white pigment at a ratio (A/B) of a total amount (A) of the binder resin and the adhesive to an amount (B) of the white pigment within a range of 1/1 to 1/10, the white layer has an adhesive property to the image receiving portion on which an image has been formed, the white layer has a thickness of 0.5 to 2.0 $\mu$m and a white layer is disposed on the substrate sheet through a peeling layer, thermally transferring a dye from the dye layer to a receptor layer of the image-receiving portion to thereby form an image; and forming a white screening layer by thermally transferring the white layer of the thermal transfer sheet on the receptor layer on which the image is formed.

* * * * *